United States Patent [19]

Kemper

[11] 3,994,628

[45] Nov. 30, 1976

[54] MULTIPLE RECIRCULATING TOILET

[75] Inventor: James M. Kemper, Hollywood, Calif.

[73] Assignee: Monogram Industries, Inc., Santa Monica, Calif.

[22] Filed: Apr. 13, 1972

[21] Appl. No.: 243,897

Related U.S. Application Data

[63] Continuation of Ser. No. 16,740, March 5, 1970, abandoned.

[52] U.S. Cl. ..... 417/12; 417/307; 417/288

[51] Int. Cl.[2] ..... F04B 49/00

[58] Field of Search ..... 417/7, 8, 12, 288; 222/63

[56] References Cited

UNITED STATES PATENTS

| | | | |
|---|---|---|---|
| 2,612,838 | 10/1952 | Nichols | 417/288 |
| 2,617,361 | 11/1952 | Neal | 417/288 |
| 2,797,846 | 7/1957 | Reed | 222/63 |
| 2,812,110 | 11/1957 | Romanowski | 417/8 |
| 2,945,445 | 7/1960 | Smith et al. | 417/7 |
| 3,229,639 | 1/1966 | Highnutt et al. | 417/12 |
| 3,639,081 | 2/1972 | Gray et al. | 417/7 |

*Primary Examiner*—William L. Freeh
*Attorney, Agent, or Firm*—Poms, Smith, Lande & Glenny

[57] ABSTRACT

A pumping system for a plurality of recirculating toilets sharing a common tank is described. A variable volume pump has a by-pass valve which is controlled by a pressure sensor in the flush line, to prevent excessive fluid pressure at the toilets. For applications in which the total number of toilets in the system requires a flow exceeding the output of a single pump, additional, substantially identical pumps are provided. A time delay circuit is connected to a pressure switch for energizing a second pump, if the fluid pressure at the toilets does not exceed a predetermined pressure within a set time interval.

4 Claims, 4 Drawing Figures

James M. Kemper,
INVENTOR.
BY.

GOLOVE & KLEINBERG,
ATTORNEYS.

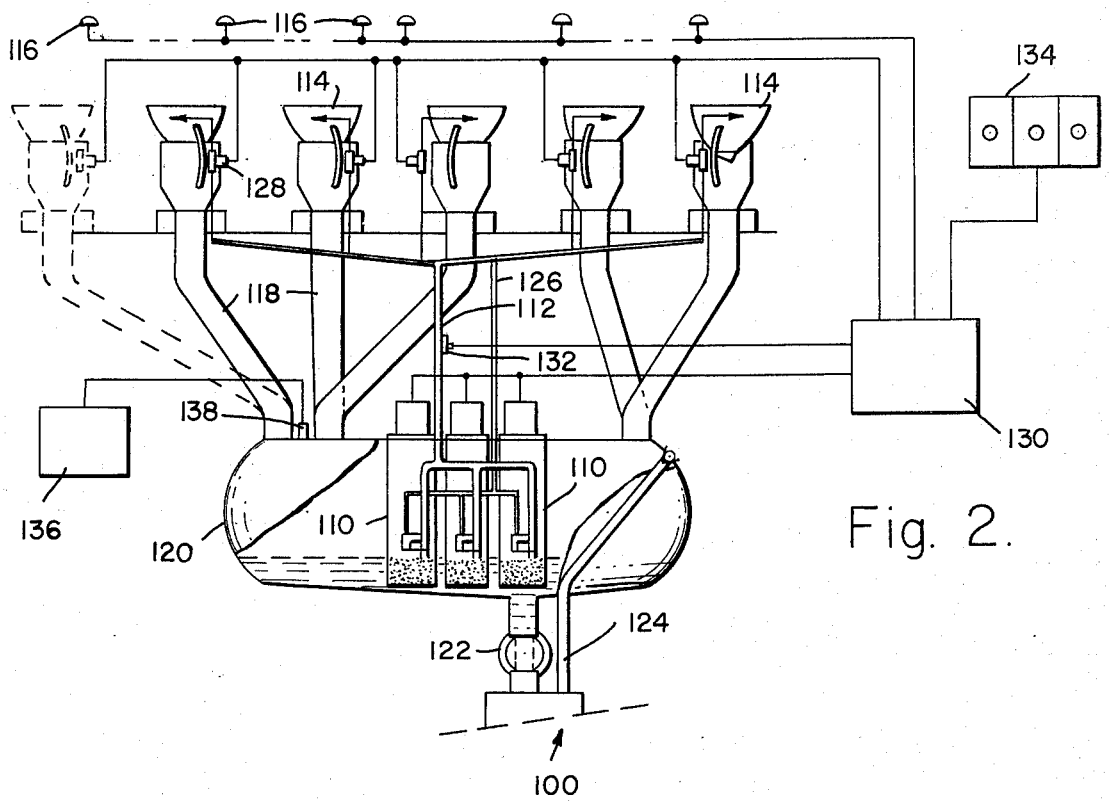
Fig. 2.
Fig. 4.
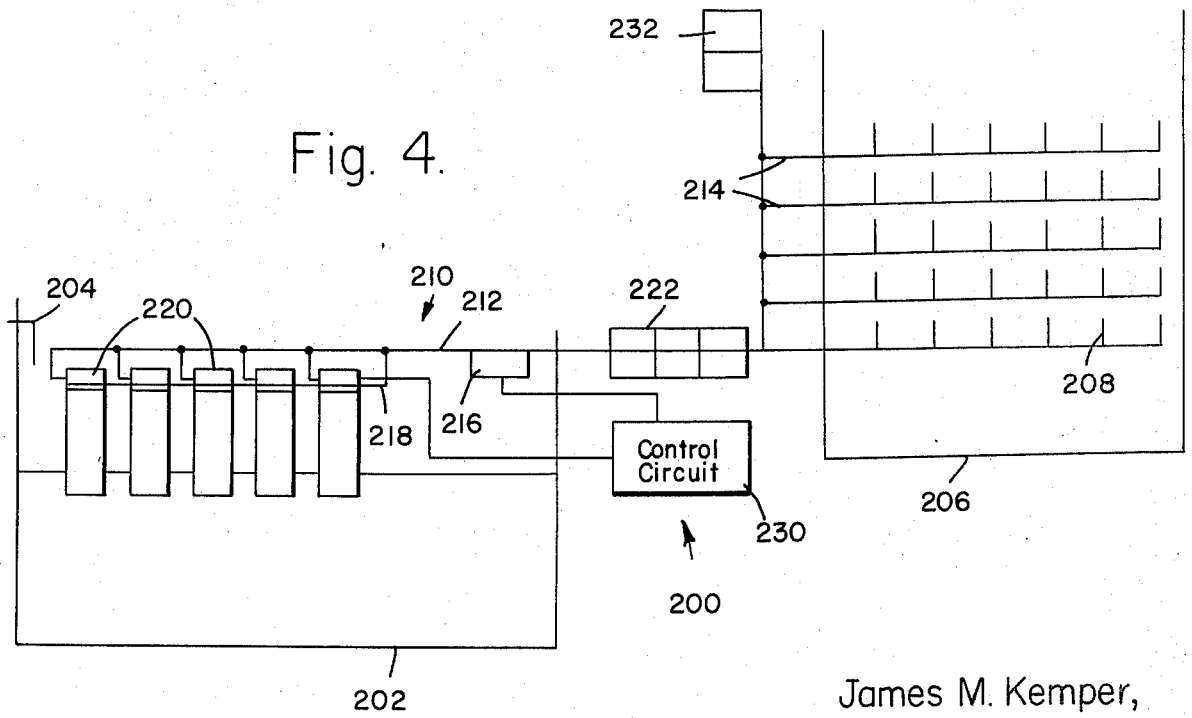
James M. Kemper,
INVENTOR.
BY.
GOLOVE & KLEINBERG,
ATTORNEYS.

MULTIPLE RECIRCULATING TOILET

This application is a continuation of application Ser. No. 16,740 filed Mar. 3, 1970, now abandoned.

This invention relates to circulating fluid systems and, more particularly to an improved recirculating system having a plurality of fluid utilization devices sharing a lesser plurality of pumping devices.

In self-contained, recirculating sanitation systems, of the type currently in use on large aircraft, and, to some extent on trains and other vehicles, it has been the practice to use a plurality of substantially independent, recirculating toilet systems, each with its own filter and pump assembly and storage tank.

Typical self-contained recirculating toilet systems have been shown, for example in the patent to J. W. Deitz, et al, No. 3,067,433, or in the patents to N. J. Palmer, U.S. Pat. Nos. 3,458,049 and 3,473,171, among others. An improved system which provided a common tank and filter connected to a pair of independent toilets, each with its own pump has been disclosed in the patent to Corliss, U.S. Pat. No. 3,079,612.

As the size of aircraft and other vehicles increase to accomodate greater numbers of passengers for journeys of substantial duration, sanitation facilities must be provided in sufficient numbers to serve the expected usage. However, an important consideration for the proprietor of the aircraft or vehicle, is the time-required to perform maintenance on the sanitation system, and the time required for vehicle "turn around", during which the sanitation system must be serviced, and when necessary, drained and recharged with fresh fluid.

With systems of the prior art, the provision of individual tanks for each toilet unit is less than satisfactory because of the servicing time required. The system described by Corliss, represents a substantial improvement in that only a single tank need be drained and recharged for each pair of toilets. Yet other problems arise in systems employing a plurality of toilet units, each with its own pump. If, for any reason, a pump becomes disabled, then its toilet is inoperable and out of service, thereby limiting the facilities available for use. Because space on vehicle is at a premium, it is uneconomical to provide extra facilities and any failure is likely to result in substantial passenger inconvenience.

Further, the additional usage imposed upon the remaining toilets may, in fact, accelerate any incipient failures which would then compound the problem. It is also to be noted that the task of maintaining toilet systems is not the most desirable one, and it has been deemed preferable to limit, wherever possible, the number of elements requiring repair, service, or maintenance. Other systems have been suggested in which a single, high volume pump is connected to serve several toilet units all of which share a common storage tank. Each toilet has a three-way valve which by-passes unwanted flush water back to the waste tank when the toilet is not being flushed. In order to flush a particular toilet, the three-way valve is operated to divert flush water into the bowl instead of the drain line. Such a system has several disadvantages. For example, with this system, the pump filter is operating at full capacity at all times whether one or all toilets are being flushed, the contents of the storage tank are continually being agitated, and solids are kept flowing toward the filter, increasing the likelihood of filter clogging.

In accordance with the present invention, it has been discovered that an "oversize", high volume pump can be modified to serve a plurality of toilet units. In a preferred embodiment of the invention, a high volume pump is provided with an internal by-pass relief valve, that returns fluid from the outlet side to the inlet side of the pump thus by-passing the output line. The relief valve is controlled by a pressure sensor connected to the output line. When a toilet flush valve is actuated, the pump is energized and the pressure sensor ascertains the fluid pressure in the line.

If the fluid pressure exceeds a preset limit, the relief valve is operated to divert fluid flow from the output line, thereby reducing the pressure in the output line.

Each flush valve has a flush timing circuit which holds the valve open for a preset interval, during which flushing liquid is applied to the toilet. Therefore, the water volume going through the filter is only that volume required to flush the toilets being used.

Should a second toilet be actuated during the operation of the first toilet, the pressure sensor detects the drop in fluid pressure and the relief valve is adjusted to maintain the pressure at the toilets. Further, a timing circuit associated with the second toilet extends the operation of the pump to assure a full flushing interval for the second toilet. When the timing circuit of the first toilet closes the first toilet flush valve, the increase in pressure is signalled to the relief valve, which is then operated to increase the by-pass flow, thereby maintaining the pressure.

In an alternative embodiment, a partly redundant system is provided which includes a pair of substantially similar, high volume pumps, connected in parallel to the several toilets. Each pump is equipped with a controllable relief valve. An electronic cycling circuit is provided to select the pumps for alternate operation. A second timing circuit is provided, which is connected to a second pressure sensor and the cycling circuit. If, after a preset time interval, the fluid pressure at the second sensor has not reached a preset magnitude, the other pump is started.

In yet alternative embodiments, three or more high volume pumps are provided to serve a larger number of utilization devices. These embodiments may include fluid supply systems for a large plurality of devices where it is inconvenient to maintain a sufficiently high fluid pressure in the line at all times. In these embodiments, a cycling circuit energizes each of the pumps, in turn. If a second toilet, or other utilization device is operated while a first toilet is flushing, the timing circuit merely extends the operation of the pump. If more toilets are operated and the output of the one pump is insufficient to maintain the desired pressure at the sensor, then a second pump is called into operation. Similarly, if two pumps are insufficient, a third pump is energized.

In alternative embodiments, the system serves as the water supply for a remote, multiple-unit dwelling, such as a hotel, where a large water supply can be maintained available with a reasonably slow refilling ability, but where the high pressure necessary to service all of the fluid needs of the structure is difficult to achieve. A plurality of high volume pumps can be provided with a pressure sensor on the output lines such that, as the demand increases thereby dropping the pressure, additional pumps are energized to maintain the pressure.

Further, to equalize the use of the pumps, a cycling circuit can be provided to alternately energize different pumps in a predetermined cycle.

In yet other embodiments, one or more of the pumps may be kept out of the normal operating cycle to be utilized as stand-by or reserve pumps, to be used only in the event of a failure of pumps normally included in the operating cycle.

The novel features which are believed to be characteristic of the invention, both as to organization and method of operation, together with further objects and advantages thereof will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

FIG. 2 is a schematic view of a recirculating sanitary system according to the present invention;

FIG. 4 is a schematic of a water supply system according to the present invention.

Figure 1:
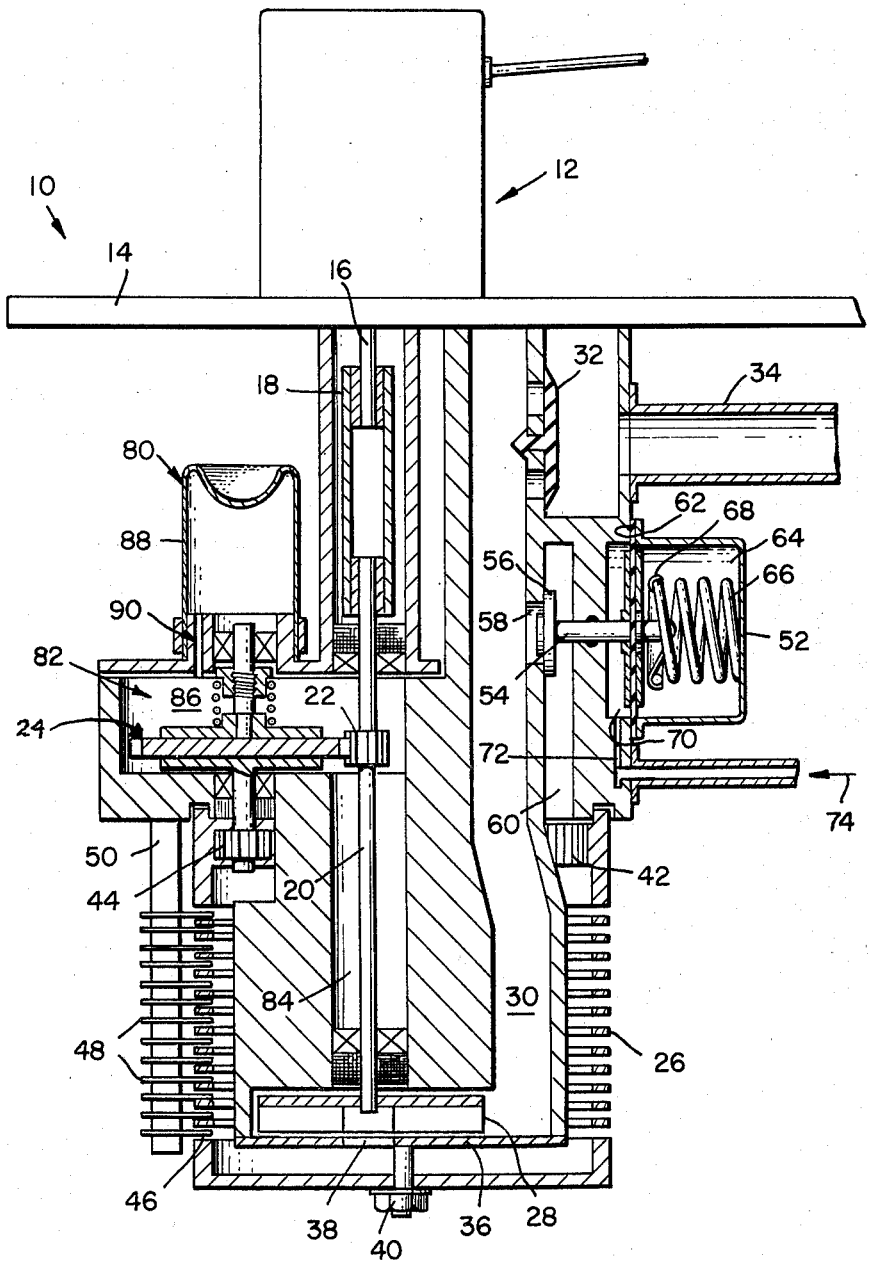
FIG. 1 is a side sectional view of a variable volume pump according to the present invention.

FIG. 1 is a side sectional view of a variable volume pump 10 according to the present invention, and suitable for use in the systems described below. The pump 10 includes a motor 12 which is fastened to a top cover plate 14. A motor drive shaft 16 passes through the plate 14 and is coupled, by a connector member 18, to a pump drive shaft 20.

The pump drive shaft 20 includes a drive gear 22 which meshes with a transmission assembly 24, to rotationally drive a filter basket 26. The pump drive shaft 20 terminates in a pump impeller 28 which draws fluid from the pump interior and drives the fluid through an outlet duct 30. A check valve 32 in the duct 30 permits unidirectional flow of fluid from the pump to an output line 34, which is coupled to the several utilization devices (not shown). A small by-pass orifice (not shown) is provided adjacent to the check valve 32 to facilitate self-draining of the output lines and to preclude freezing of the lines in low temperatures.

The filter basket 26 is rotatably attached to a pump bottom plate 36, which includes a pump inlet orifice 38, by fastening means, here shown as a bolt 40. The filter basket 26 itself has a ring gear 42, integral with the inner periphery of the basket 26 at its upper, open end. A filter basket drive gear 44 is driven from the gear train of the transmission assembly 24.

The filter basket 26 includes a plurality of parallel circumferential slots 46 which serve to filter the fluid taken into the pump 10. A plurality of scraper blades 48 is carried by a suitable shaft 50. The blades 48 protrude through the slots 46 to dislodge any solid matter as the basket 26 rotates.

Thus far, the pump 10 is generally similar to pumps of the prior art which have been employed in similar systems. The pump 10, in addition, includes a by-pass valve 52 which is controlled by the pressure in the output line 34. The by-pass valve 52 includes a valve stem 54 which carries a valve head 56 that seats against a by-pass opening 58 in the pump outlet 30. When opened, the by-pass valve 52 permits fluid to flow through the by-pass opening 58 to a return line 60 which is opened to the interior of the filter basket 26.

The by-pass valve stem 54 extends through a fluid impermeable diaphragm member 62. In a separate, vented chamber 64, the valve stem 54 is biased into the closed position by a spring member 66, resting upon a spring plate 68. In the valve chamber 70, which is separated from the sealed chamber 64 by the diaphragm 62, a fluid inlet 72 is provided which couples to a pressure sensing line 74.

By appropriate selection of the dimensions of the pressure sensing line 74, or of the coupling member which connects the pressure sensing line 74 to the main output line 34, the operating region of the by-pass valve 52 can be determined. When the pressure in the output line 34 rises above a predetermined setting, approximately 10 PSI, the fluid pressure in the valve chamber 70 exceeds the bias spring pressure and the valve stem 54 is moved to the right as viewed in FIG. 1, opening the valve.

Fluid then by-passes the output line 34 and returns to the inlet side of the pump through the interior of filter basket 26 through the by-pass return 60. The low "impedance" return path reduces the pressure in the output line 34. Since a substantially closed feedback loop is involved, the pressure in the output line 34 will stabilize at the preset magnitude. If more than one utilization device is "on-line", the pressure in the output line 34 will drop. A reduction of pressure enables the bias spring 66 to move the valve stem 54 to the left, closing the by-pass valve 52 and increasing the pressure in the output line 34.

As an additional feature of the pump 10, a differential pressure equalizer assembly 80 is provided to protect the transmission assembly 24 and a gear box 82 in which it is located. Normally, the gear box 82 and the housing 84 in which the pump drive shaft 20 is located, are charged with a lubricant 86. Shaft seals are of course provided to prevent fluids from entering the gear box 82 and to prevent lubricant 86 from leaking out of the gear box 82. Since a primary cause of leakage would be a pressure differential, as between the interior of the gear box 82 and the environment in which it is located, the pressure equalization assembly 80 is provided. An elastic, fluid tight bag member or envelope 88 is fastened to the exterior of the gear box 82 and is in fluid communication therewith through a duct 90.

While the lubricant 86 normally stays within the gear box 82, any lubricant that might escape is retained within the interior of the envelope 88. Any changes in pressure either cause the envelope 88 to expand or contract, thereby providing a variable volume which can be affected by pressure changes. Any leakage of lubricant 86 is retained in the envelope 88. Subsequent pressure changes permit the lubricant to be returned to the gear box 82.

Turning now to FIG. 2, there is shown as a preferred embodiment, a typical system in which the pump of FIG. 1 is used. It is to be understood that in any application employing the pump of the present invention, a plurality of utilization devices are to be served. If a single pump is to be utilized, the pump must be capable of furnishing a fluid flow exceeding the demands of all of the devices operating simultaneously. If the demands of all of the utilization devices exceed the capacity of a single pump, then additional pumps are necessary in order to serve all of the utilization devices with a margin of safety.

A recirculating waste disposal system 100 is illustrated in FIG. 2 such as is in use on large, multi-passenger vehicles, for example, commercial air transports. A plurality of substantially identical pumps 110, in this embodiment, three, is commonly connected to a single flush manifold 112 which serves several, substantially identical, toilet assemblies 114.

A push button switch 116 is provided for each of the toilet assemblies 114, which controls the initiation of a toilet flush cycle. A waste return line 118 couples each toilet assembly 114 to a single holding tank 120 in which the several pumps 110 are located. For servicing purposes the tank 120 is provided with a drain valve 122 and a tank flushing line 124. These are utilized for draining, cleaning, and refilling the tank 120 as a part of a routine service or maintenance operation on the vehicle.

The pumps 110 are commonly connected to a pressure sensing line 126, of a smaller diameter than the flushing manifold 112 which is adequate to "signal" pressure in the line to the by-pass valves of the pumps 110. Each of the toilet assembiles 114 is coupled to the flush manifold 112 through a solenoid flush valve 128 which is operated by an electrical control assembly 130, described in greater detail in connection with FIG. 3 below. A pressure switch 132 applies an electrical signal output to the control assembly 130.

In the event of the failure of any of the pumps 110, a failure warning indicator panel 134 is provided at a remote location, so that repair crews can be alerted to repair or replace the failed pump. A second, fluid level indicator panel 136 is provided in the vicinity of the drain valve 122 and the tank flush line 124, so that service personnel can determine fluid level within the tank 120. A liquid level sensor 138 is provided to drive the fluid level indicator panel 136.

When a flush cycle is to be initiated at a toilet assembly 114, the push button 116 is depressed, signalling the control assembly 130. A pump 110 is then selected and power is applied to its motor. If operable, the selected pump 110 will begin pumping fluid into the flush manifold 112 and the fluid pressure in the line will rise. The solenoid flush valve 128 corresponding to the selected push button 116 is also energized to open.

As the fluid pressure in the flushing manifold 112 increases, pressure switch 132 is operated, signalling to the control assembly 130 that the pressure has reached a predetermined minimum. The fluid is then applied to the appropriate toilet assembly 114 through the open flush valve 128 and that toilet is flushed. The pressure sensing line 126 operates the by-pass valve in the selected pump to maintain the pressure in the flushing manifold 112 below a preselected maximum.

A timing circuit within the control assembly 130 maintains the flush valve 128 open for a timed flushing interval. At the expiration of that interval, the flush valve 128 is closed and the pump motor is de-energized.

If, during the flushing interval of a first toilet assembly 114, a second toilet push button 116 is actuated, a second, independent, time interval is initiated and the associated flush valve 128 is opened. Since a pump is already operating, fluid in the flush manifold 112 is available to the second toilet assembly. The drop in pressure is communicated through the pressure sensing line 126 to the by-pass relief valve which closes sufficiently to restore the pressure in the flushing manifold 112. At the conclusion of the timed interval for the first toilet assembly, its flush valve 128 closes, thereby resulting in an increase in fluid pressure in the line which is communicated to the pressure relief valve. In response to this pressure increase, the valve opens to maintain the pressure level.

With several of the toilet assemblies 114 flushing at the same time, if a single pump is incapable of maintaining pressure in the flush manifold 112 greater than the lower limit of the pressure switch 132, a second signal is provided to the control assembly 130. In response to this second signal, a second pump 110 is energized and a relatively short, timed interval is initiated.

If the second pump is functioning properly, the pressure in the line is immediately restored and the pressure switch 132 signals that condition to the control assembly 130. However, if for any reason, the pressure in the line is not restored by the end of the short, timed interval, the control assembly 130 energizes a third pump 110. The third pump may alternatively be a standby, emergency unit, or may be merely the third pump of a three-pump cycling system which sequentially energizes each pump, in turn.

At this point in the discussion, it is to be assumed that the sole reason for the pressure drop in the manifold 112, requiring the energization of additional pumps 110, was due to the concurrent operation of additional toilet assemblies exceeding the capacity of the initially selected pump. However, in the case of a pump failure, the same operational sequence is followed. In addition, on the initial energization of a button 116 and at the expiration of the first short timed interval, if a second pump must be called into service, a failure light of the warning panel 134 is energized to signal that the initially selected pump is inoperable.

If a pump failure should be experienced during a flushing cycle, the dropping pressure in the flush manifold 112 will be signalled by the pressure switch 132 to the control assembly 130. In this event, a pump energizing signal will be applied to activate another of the pumps. The failure light of the warning panel 134 will be activated when the failed pump is next addressed in its normal turn in the operational cycle.

In an alternative embodiment, wherein two pumps are alternately energized, a third pump is provided as a back-up or standby pump, and is not normally used. If one of the primary pumps fail, or both primary pumps are unable to maintain adequate pressure in the line, the third pump will be operated, routinely.

The control circuits for operating the system 100 as described above, are illustrated schematically in FIG. 3. It will be understood by those skilled in the art that the particular arrangement of FIG. 3 is illustrative only and that other, equivalent mechanizations are available to accomplish the desired operation.

Figure 3:
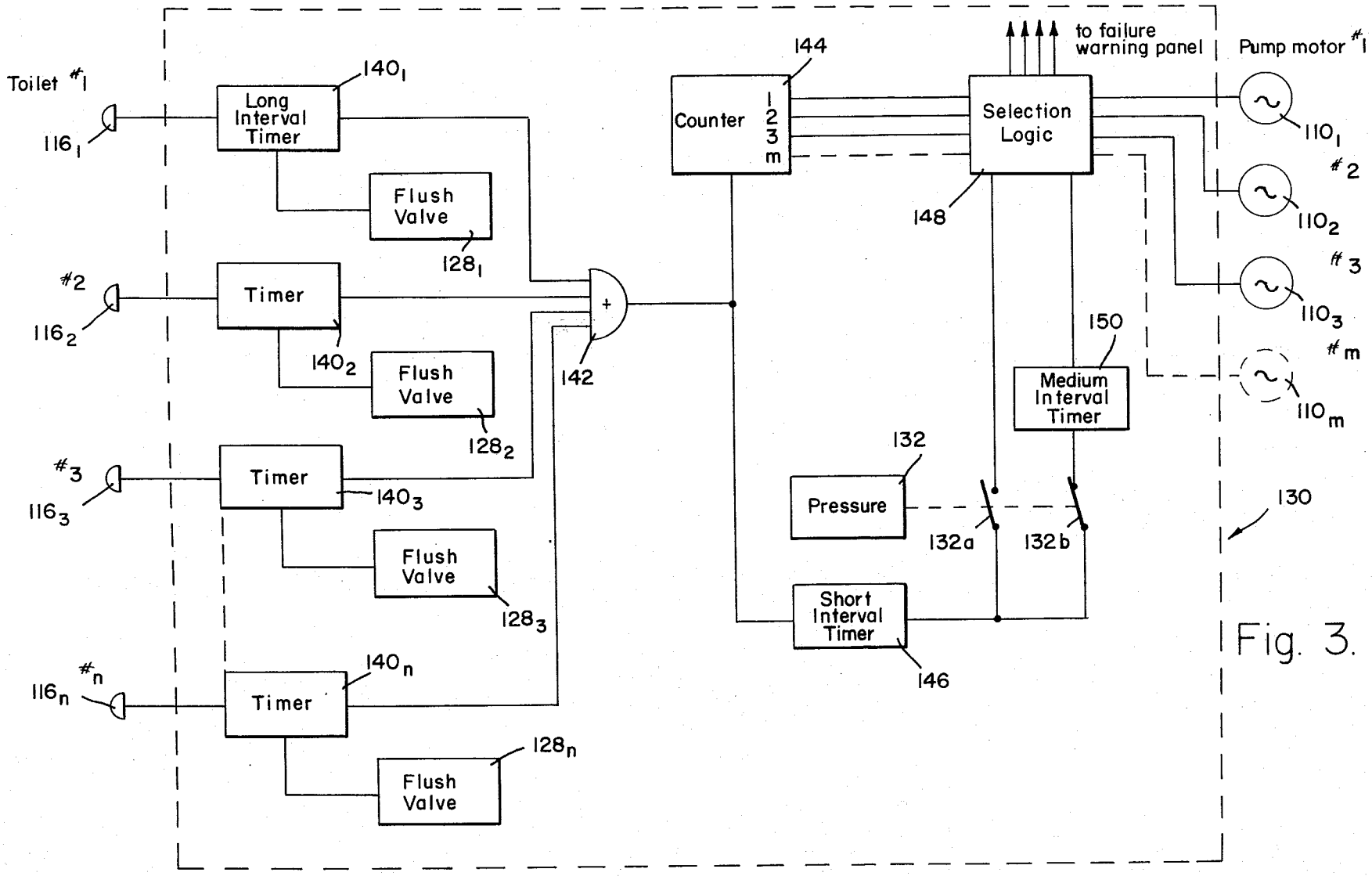
FIG. 3 is a block diagram, partly schematic, of the control system for the sanitary system of FIG. 3.

FIG. 3 has been generalized to cover a system having N toilet assemblies and M pumps. This is indicated by applying to the reference numerals of the several switches 116 a subscript "1" through "*n*". Similarly, the flush valves 128 are also suitably subscripted 1 through *n*.

Connected to each push button 116, is a relatively long, interval timer circuit 140. The long timer circuit 140 is intended to be energized for a predetermined, adjustable time interval and provides a continuous output during the timed interval. One output of the timer circuit 140 is applied to energize the flush valve 128 and a second output is applied through an "or" circuit 142, which applies its output to a counter 144 and to a second, relatively short, interval timer 146.

The or circuit 142 receives substantially similar inputs from each of the long interval timers 140 and provides a single output to the remaining elements of the control circuit 130.

The counter 144 may be a ring counter or any other conventional, addressing circuit which sequentially selects, in turn, M different output lines, all of which are applied to a selection logic circuit 148 which ultimately determines which of the M pumps 110 to energize.

The output of the short interval timer 146 is applied on a first line through a normally closed set of switch contacts 132*a* to the selection logic circuit 148, and, on a second line through a second set of normally closed switch contacts 132*b*, to a "medium" interval timer 150. The output of the medium interval timer is also applied to the selection logic block 148.

The normally closed switch contacts 132*a* and 132*b* are directly controlled by the pressure switch 132 which, in this embodiment is arranged to maintain switches in the closed configuration so long as the pressure detected is less than a preset magnitude. When the pressure exceeds the minimum limit, the two switches 132*a* and 132*b* are opened, interrupting both circuits to the selection logic circuit 148.

As is well known in the design and construction of data processing equipment, the operation of the control circuit 130 can be represented by a series of logical equations which define the conditions under which an output is provided. Once these equations have been formulated, then it is routine to design the appropriate structural elements that operate in accordance with these logical equations.

In operation, it will be seen that as a push button 116 is actuated, the relatively long timer 140 is energized, which times the flush cycle. A counting impulse is applied to the counter 144 to select one of the pumps. The selection is signalled on the appropriate output line to the selection logic block 148, which immediately energizes the selected pump.

The relatively short interval timer 146 is energized for an interval, believed adequate to permit the selected pump to come to full pressure in the line. The pressure switch 132 switch contacts 132*a* and 132*b* will be opened by the pressure increase and at the time that a signal output is provided by the short interval timer 146, the circuit will be open.

If the pressure in the line is not adequate to open switch contacts 132*a*, 132*b*, within the time interval of the short interval timer 146 then a signal is applied by the timer 40 to the selection logic 148 and to the medium length timer 150. If the pressure in the line remains insufficient to open the switch contacts 132*a*, 132*b* before the medium interval timer 150 provides an output, then the signal provided by timer 150 is applied to the selection logic 148 which in turn energizes the third motor of the sequence.

During a flush cycle, if the pressure drops sufficiently to reclose the switch contacts 132*a*, 132*b*, a second pump is immediately energized, and if pressure is not restored within the interval timed by the second timer 150, a third pump is energized.

It is not believed essential to describe the detailed logic required to select the appropriate failure warning lights. It will be obvious to those skilled in the art that the circumstances dictating the lighting of the failure lamps can be easily expressed in logical terms which can be simply mechanized.

The successive energization of more than one push button 116 will not affect the state of the counter 144 so long as a pump is running. However, as soon as the latest flush cycle is concluded, and the pumps de-energized, the next energization of a push button 116 will advance the counter 144.

In summary, the circuit diagram illustrated in FIG. 3 conveys sufficient information so that one reasonably skilled in the recirculating toilet system art could design a toilet system which would carry out the teachings of the invention.

The following is a step-by-step analysis of FIG. 3, which analysis could be made by one of reasonable skill in the recirculating toilet system art and would result in an operative system carrying out the teachings of the subject application.

STEP-BY-STEP ANALYSIS OF FIG. 3 OF THE DRAWING

Pushing one of the push button switches 116 activates one of the long interval timers 140 as, for example, a Magnecraft No. W112MSRX-2 Slow Release Timer, distributed by Kierulff Electronics of Los Angeles, Calif. which will provide a positive output voltage to both the flush valve 128 and OR gate 142 for a time determined by the setting on timer 140. At the end of the timing cycle, both outputs will return to the off or "low" state which turns off flush valve 128 and de-activates OR gate 142.

OR gate 142 can be simply a common tie point for all its inputs and its output, which would be referred to as "Wired OR", or it could be an active circuit as, for example, as RCA CD2152 circuit, manufactured by RCA and distributed by Newark Electronics of Chicago, Ill. The reason for using an active circuit OR gate would be to isolate the inputs from each other and from the output if this was necessary due to the type of timers and counters selected for us.

The function of the OR gate 142 is to provide a steady positive voltage or "high" output to the counter 144 and short interval timer 146 as long as any one or combination of long interval timers 140 have a positive or high output.

Counter 144 can be a mechanical stepper as, for example a Guardian Relay Stepper — Rotomite IR-705-12P-24P by Newark Electronics, or a shift register connected to function as a ring counter as, for example, Motorola MC794 Shift Register. The function of the counter 144 is to provide a positive voltage or high output on one of its multiple outputs as long as the one input line from OR gate 142 is positive or high. Every time the input to counter 144 goes through a positive or "high" to off or low state cycle, the counter "counts" one position on its output lines so that the next on cycle will provide a voltage on the next output in line. This has the effect of sequencing the outputs each time a pumping "on-off" cycle is completed.

The selection logic as described hereinabove selects three pumps on a priority basis of primary, first backup and second backup. The pump selected for each of these functions is determined by which output line from the counter 144 is positive or high. The pump selected as primary will be activated as soon as positive voltage is applied by the counter 144. The selection logic circuit 148 of FIG. 3 may have a suitable arrangement of AND gates, such as a Motorola M C 9713 "Quad 2 input AND gate", manufactured by Motorola and also distributed by Newark Electronics, such gates having a positive voltage or high output only when all inputs are positive or high. Circuit 148 may also have a suitable arrangement of Motorola OR gates as, for example, MC 9715 Quad 2 input OR gate, manufactured by Motorola and distributed by Newark Electronics, such gates having a positive voltage or high output if any one or combination of inputs is positive or high. Thus, if counter 144 has a positive voltage on output No. 1, this voltage is applied to an OR gate in circuit 148, which satisfies the condition necessary to get a positive voltage on the OR gate output thereof, thereby activating pump motor 110 No. 1. It can also be seen that the same No. 1 output from counter 144 is applied to one input each of two AND gates in circuit 148 thereby partially satisfying the necessary requirements to get a positive output from each of these AND gates in circuit 148. To find the source of the other input necessary for each of these AND gates in circuit 148, one can follow the other path of the positive voltage provided by OR gate 142.

OR gate 142 thus gives a positive voltage whenever any one or combination of its inputs is positive. This positive voltage is applied to short interval timer 146 as long as a long interval timer 140 is activated. Short interval timer 146 as, for example, a Magnecraft No. W112MSOX-3 slow operate timer, which is manufactured by Magnecraft and distributed by Kierulff Electronics, will only give a positive voltage output after the input voltage has been present for a pre-set time interval. This time interval is selected to give a normal operating pump sufficient time to build up enough pressure in the water line to open pressure switch 132 before short interval timer 146 provides its positive voltage output. This prevents the positive output of timer 146 from going any farther because of the open contacts of switch 132.

If the pressure in the water line does not build up enough to open switch 132 before the positive voltage from timer 146 is provided, or drops enough to close switch 132 after the interval provided by timer 146, such as due to a faulty pump, then the positive voltage is applied to one input of half of the AND gates in the selection logic 148 and to the input of medium interval timer 150. It will be remembered that one of these AND gates had positive voltage applied to one input by the counter 144. This AND gate then will provide a positive voltage at its output because both of its inputs will be high. The positive voltage provided by its output will be applied to an OR gate which in turn will apply a positive voltage to activate pump motor No. 2.

As stated earlier, short interval timer 146 provides a positive voltage on its output after its time interval and through the contacts of switch 132 to medium interval timer 150 if switch 132 has not opened yet because of a failure of the water pressure to build up to the required level. The medium interval timer as, for example, the previously mentioned Magnecraft No. W112MSOX-3 slow operate timer, will provide a positive voltage output if the input voltage is present for the full duration of its preset time interval. After the preset time interval, a positive output voltage will be provided as long as the input voltage remains high. This interval is chosen to allow the second pump sufficient time to build up pressure in the water line and open the contacts of pressure switch 132 therefore stopping the timer 150 before it can provide a positive output. Under such a condition it would be reset and, upon reapplication of a positive input, would start its timing interval all over. If the second pump does not provide enough pressure within the allotted time, timer 150 will provide a positive voltage to one input of each of the other half of the AND gates not provided an input by timer 146. One of these AND gates will have an input provided by counter 144 thereby satisfying the conditions necessary to provide a positive voltage on its output. This output will then be applied to the input of an OR gate which satisfies its requirements for a positive voltage on its output which in turn activates pump motor No. 3. The outputs of the AND gates are also connected to a second set of OR gates so that at any time it is necessary to activate a second pump, by way of the AND gate circuitry, a signal is applied to the warning panel indicating that the primary pump could not provide the necessary pressure thus indicating a pump malfunction.

If the sequence above is repeated for each successive output of the counter 144, it will be seen that the pumps are rotated through a 1, 2, 3 sequence of assignment as a primary, first backup, and second backup role for providing the necessary water line pressure.

The novel, variable flow pump 10 of the present invention is not limited to use in recirculating toilet systems. As an example of a different system in which such a device could be useful, attention is now directed to FIG. 4 in which there is illustrated a water supply system for a multi-story structure. Normally, it would be necessary to provide a high volume, high pressure water line to serve the structure, with the understanding that full pressure will at all times be applied to all of the water lines and, that if all of the outlets are in use, the flow at each will be inadequate.

According to the present invention, however, a reservoir 202 is provided which is adapted to be filled from a relatively low volume supply line 204, which can run substantially continuously. The multi-story structure 206 may be considered as including five floors each with a plurality of water-using outlets 208 which are individually controlled.

As shown, the water distribution circuit 210 includes a main water line 212, which then branches into five secondary water lines 214, each of which serves the water needs of one floor of the structure 206. A pressure sensor 216 is connected in the main water line 212 and may be substantially similar to the pressure switch described hereinabove. A pressure sensing line 218 also is connected into the main water line 212, and is applied to each of, in this example, five, demand volume, variable-flow pumps 220.

It will be assumed that each pump is adequate to supply the fluid flow needs of more than one floor so that four pumps are more than adequate to serve the five floors of the structure 206, providing a safety margin of an extra pump 220.

Inasmuch as the system 200 in FIG. 4 is a demand system, not started by actuation of a push button, a flow meter 222 has been included in the main fluid line 212, and provides a signal proportional to and representative of the fluid flow through the main line 212. A control circuit 230 is connected to receive inputs from the pressure switch 216 and the flow meter 222, and provides output energizing signals to the several pumps 220.

In operation, the system 200, in its quiescent state, maintains some nominal water pressure throughout the system with no pumps running and all water outlet valves closed. It is to be understood that the supply system itself can be considered a reservoir, but an accumulator tank 232 is provided to prevent water hammer and other problems resulting from the normal incompressibility of the fluid.

As a water valve is opened anywhere in the building 206, the pressure in the line drops. The pressure sensor 216 detects the fall of pressure below a preset limit and a signal is generated which selects a pump 220 and sends an energizing signal to the selected pump. The selected pump 220 operates to restore the pressure in the line 212. This condition is sensed by the pressure switch 216. At the same time, the pressure sensing feedback line 218 regulates the flow from the operating pump 220 to maintain the pressure at a nominal, desired output level. The flow meter 222 provides a signal indicating that fluid is flowing in the line. As a result the open valve provides a water flow.

As additional valves are opened, the pressure drops, and, to the extent that the single pump can supply the need, the by-pass valve is adjusted to maintain the pressure in the line. When the capacity of the pump is exceeded, the pressure falls and the control circuit 230 energizes a second pump 220. As additional demands are made upon the water supply, additional pumps are called into service. The pressure sensing line 218 prevents the pressure from rising above a predetermined maximum and the pressure switch directs the energization of additional pumps to maintain the pressure above a preset minimum.

As the various outlet valves are closed, the pressure in the line builds up and the rate of flow drops. The flow meter 222 can then determine when to de-energize pumps. Typically, when a flow rate is reached which normally could be fully supplied by one pump, all pumps in excess of two are de-energized. When all valves are turned off and the flow ceases, then all pumps are de-energized.

The situation of pump failure can be accommodated in much the same fashion as in the vehicle system discussed in connection with FIGS. 2 and 3 above. That is, the inability of the operating pumps to maintain pressure in the line causes the pressure sensor 216 to signal a low pressure condition which results in the energization of yet additional pumps.

It may be desirable to include timer delays so that an inoperable pump is not deemed faulty if the pressure switch 216 does not sense adequate pressure simultaneous with the energization of a pump. As will be understood, the flow meter 222 is necessary to prevent a pump from running continuously, in the absence of any demand for water in the distribution system. However, other arrangements consistent with the present invention can be devised by mechanics skilled in the art without the exercise of additional invention.

What is claimed as new is:

1. A fluid distribution system adapted to supply fluid to a multiplicity of utilization devices, comprising:

a. a plurality of pumps, connected to the system in parallel, each operable in response to fluid pressure feedback signals for varying the volumetric flow to maintain a preselected system fluid pressure;

b. feedback means coupled between the system and the pumps of said plurality to apply pressure feedback signals;

c. a pressure sensor for sensing system fluid pressure and for generating first signals representing fluid pressure below a desired magnitude, and d. control means connected to said pumps and said pressure sensor for energizing the pumps of said plurality in a predetermined sequence, in response to said first signals;

e. said control means including timing means, adapted to delay said first signals for a first timed interval whereby said first interval is provided for an energized pump to raise system fluid pressure above the desired magnitude;

f. a multiplicity of switches, each being located at a utilization device;

g. said multiplicity of switches being connected to said control means; and h. said control means further including selecting means for pre-selecting a one of said pumps in a second sequence, said control means being operable in response to a switch actuation or energizing a pre-selected pump, said control means being further operable in response to said first signals for energizing a non-preselected one of said pumps in the predetermined sequence, said control means being operable in response to said first signals for sequentially energizing additional ones of the non-preselected pumps in the predetermined sequence until fluid pressure in the system exceeds the desired magnitude and said first signals cease.

2. A fluid distribution system adapted to supply fluid to a multiplicity of utilization devices, comprising:

a. a plurality of pumps, connected to the system in parallel, each operable in response to fluid pressure feedback signals for varying the volumetric flow to maintain a preselected system fluid pressure;

b. feedback means coupled between the system and the pumps of said plurality to apply pressure feedback signals;

c. a pressure sensor for sensing system fluid pressure and for generating first signals representing fluid pressure below a desired magnitude, and d. control means connected to said pumps and said pressure sensor for energizing the pumps of said plurality in a predetermined sequence, in response to said first signals;

e. said control means including first timing means, adapted to delay said first signals for a first timed interval whereby said first interval is provided for an energized pump to raise system fluid pressure above the desired magnitude;

f. a multiplicity of switches, each being located at a utilization device;

g. said multiplicity of switches being connected to said control means;

h. said control means further including selecting means for preselecting a one of said pumps in a second sequence, said control means being operable in response to a switch actuation or energizing a preselected pump, said control means being further operable in response to said first signals for energizing a non-preselected one of said pumps in the predetermined sequence; and a multiplicity of switch timers, each connected to a switch for maintaining switch actuation for a first timed interval, whereby said preselected pump is held energized during the first timed interval, said control means including second timing means adapted to delay said first signals for a second timed interval.

3. A fluid distribution system adapted to supply fluid to a multiplicity of utilization devices, comprising:

a. a plurality of pumps, connected to the system in parallel, each operable in response to fluid pressure feedback signals for varying the volumetric flow to maintain a pre-selected system fluid pressure;

b. feedback means coupled between the system and the pumps of said plurality to apply pressure feedback signals;

c. a pressure sensor for sensing system fluid pressure and for generating first signals representing fluid pressure below a desired magnitude, and d. control means connected to said pumps and said pressure sensor for energizing the pumps of said plurality in a predetermined sequence, in response to said first signals;

e. said control means including first timing means, adapted to delay said first signals for a first timed interval whereby said first interval is provided for an energized pump to raise system fluid pressure above the desired magnitude;

f. a multiplicity of switches, each being located at a utilization device;

g. said multiplicity of switches being connected to said control means;

h. said control means further including selecting means for preselecting a one of said pumps in a second sequence, said control means being operable in response to a switch actuation or energizing a preselected pump, said control means being further operable in response to said first signals for energizing a non-preselected one of said pumps in the predetermined sequence; and a multiplicity of timing devices each coupling a switch to said control means for maintaining switch actuations through a first timed interval, said control means further including second timing means adapted to delay said first signals for a second timed interval, said control means which is operable in response to first signals for energizing a non-preselected one of said pumps being operable to sequentially energize additional ones of the non-preselected pumps in the predetermined sequence whereby said second interval is provided for an energized pump to raise system fluid pressure above the desired magnitude.

4. The fluid distribution system of claim 3 wherein said control means timing means are adapted to delay said first signals for a third timed interval, whereby a second, non-preselected pump in the predetermined sequence is energized if system fluid pressure is not raised above the desired magnitude by the end of the third timed interval.

* * * * *

UNITED STATES PATENT AND TRADEMARK OFFICE

CERTIFICATE OF CORRECTION

PATENT NO. : 3994628

DATED : November 30, 1976

INVENTOR(S) : James M. Kemper

It is certified that error appears in the above-identified patent and that said Letters Patent are hereby corrected as shown below:

In the Title Page of the Patent:

The inventor, as presently reading:

INVENTOR: James M. Kemper, Hollywood, California should read INVENTORS: James M. Kemper, Hollywood, California and Richard M. Ollila, Cerritos, California.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*